United States Patent [19]

Rubel

[11] 4,056,025

[45] Nov. 1, 1977

[54] STRIP CUTTING APPARATUS

[76] Inventor: Laurence P. Rubel, 34 Clark Drive, Howell, N.J. 07731

[21] Appl. No.: 673,101

[22] Filed: Apr. 2, 1976

[51] Int. Cl.[2] ..... B26D 5/20

[52] U.S. Cl. ..... 83/261; 83/575

[58] Field of Search ..... 83/241, 261, 259, 575

[56] References Cited

U.S. PATENT DOCUMENTS

| | | | |
|---|---|---|---|
| 2,860,703 | 11/1958 | O'Donnell | 83/575 |
| 2,881,833 | 4/1959 | Hoffee | 83/575 |
| 3,137,190 | 6/1964 | Mosher et al. | 83/261 |
| 3,167,986 | 2/1965 | Jocobs | 83/575 |
| 3,266,354 | 8/1966 | Ortner | 83/575 |

*Primary Examiner*—Donald R. Schran
*Attorney, Agent, or Firm*—Leonard R. Fellen

[57] ABSTRACT

A cutting apparatus for cutting strip material including a housing with a longitudinal and transverse axis and having an enclosed portion and an open work receiving portion, rollers for feeding strip material along the transverse axis of the open portion, and scissor-like means transversely disposed within the open work receiving portion for shearing the strip material.

17 Claims, 9 Drawing Figures

STRIP CUTTING APPARATUS

BACKGROUND OF THE INVENTION

1. Field of the Invention

The present invention relates to devices for cutting strip material, and more particularly to a strip cutting apparatus having an electronic controlled means for feeding the strip material to the blades of a scissor-like cutting action.

2. Description of the Prior Art

The need for an apparatus which will continuously feed and cut strip material into selected lenghts is long standing. In particular, manufacturers in the garment industry must accurately cut several different types of textile strip materials such as elastics, delicate, and hard materials at various angles and contours. Also, strip cutting machines must be easy to thread and must operate continuously at a rapid speed for best efficiency. Devices known in the prior art offer selectivity in regard to lengths of material cut but do not provide apparatuses which can be adjusted to effect accurate cutting of various types of materials. Also, when used to cut delicate fabrics, tearing may result as cutting apparatuses presently know cut by a chopping action wherein edges of the cutting blades remain in the same angular relationship during cutting.

A chop type cut as described above is provided by the apparatuses disclosed in U.S. Pat. No. 3,177,750 issued to E. Amemiya on Apr. 13, 1965 as well as in U.S. Pat. No. 2,865,448 issued to H. A. Mead et al on Dec. 23, 1958. This chop cut, while sucessful with paper and flexible plastics, is unsuitable for fabrics which will fray and tear.

Another feature of known devices is the use of a driven roller which is disposed beneath the strip material to be cut. This is typified in U.S. Pat. No. 2,701,013 issued to A. P. Klasing on Feb. 1, 1955 and in H. A. Mead et al and E. Amemiya. An idler roller above the strip material is urged toward the strip material forcing contact with the driven roller. The idler roller is withdrawn from the driven roller to terminate the feed of the strip material. Resultant of the force of gravity, a material having a very small degree or rigidity will frequently remain in contact with the driven roller and unwanted advancement and therefore an inaccurate length of strip material will be cut.

In H. A. Mead et al, E. Amemiya, and other devices known in the prior art the cutting stroke is effected by the urging of a cutting blade against the material to be cut by a spring. This spring exerts a constant amount of force. This constant force may be excessive for light materials and inadequate for heavy materials. In addition, as a result of the spring being subject to fatigue, the force of the cut varies with time. Retraction of the cutting blade is accomplished by a solenoid coupled to the blade by a lever and pivot assembly. The on time of the solenoid is much greater than the off time thereof as the solenoid is only deactivated to accomplish the cutting operation. When relatively long lengths of material are cut, the electricity required to keep the solenoid activated while the desired length is fed, generally causes an excessive cost. Also, as the solenoid is activated almost constantly, it is subject to wear and frequent failure.

Apparatuses presently known cannot be used as a parts cutter to cut notches into strip material or to separate parts joined by a binding material since the material to be cut must be threaded though the rollers from a position transverse to the longitudinal axis thereof as a result of the rollers being pivotally affixed on both free ends thereof within an enclosed housing.

The present invention overcomes the problems associated with the prior art by providing a strip cutting apparatus which includes means for cutting strip materials of various weights and elasticity by a scissor-like action, feed means having the driven portion thereof above the strip material to be cut, means for effecting a cutting stroke, the duration of which can be varied, means for the insertion of strip material into the feeding means from a position adjacent the lateral ends of the rollers thereof, and means for effecting the scissor-like cutting action by the activation rather than deactivation of a solenoid or the like.

SUMMARY OF THE INVENTION

Therefore, it is a primary ofject of the present invention to provide a strip cutting apparatus for use with materials of various weights and degrees of elasticity.

A further object is to provide a strip cutting apparatus which effects various types and angles of cutting by a scissor-like action to prevent fraying or tearing of the material to be severed.

A still further object is to provide a strip cutting apparatus with an accessible work receiving portion to facilitate insertion of strip material to be cut and to permit parts cuting or notching.

Another still further object is to provide a strip cutting apparatus which can be run at high speeds with great accuracy in a fully automatic state of operation.

Still another object is to provide a strip cutting apparatus which may be adjusted to vary the force of the cut effected.

Still another further object is to provide a strip cutting apparatus which consumes minimal amount of electicity to effect cutting.

Another object is to provide a strip cutting apparatus which is simple in design relatively inexpensive to manufacture, relatively compact, and very serviceable.

These objects, as well as further objects and advantages, of the present invention will become readily apparent after reading the description of a non-limiting illustrative embodiment and the accompanying drawing.

A strip cutting apparatus according to the principles of the present invention includes a housing having a longitudinal and a transverse axis and including an enclosed portion and an open portion, means for feeding strip material along the transverse axis of the open portion, and scissor-like means transversely disposed within the work receiving portion for shearing the strip material.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
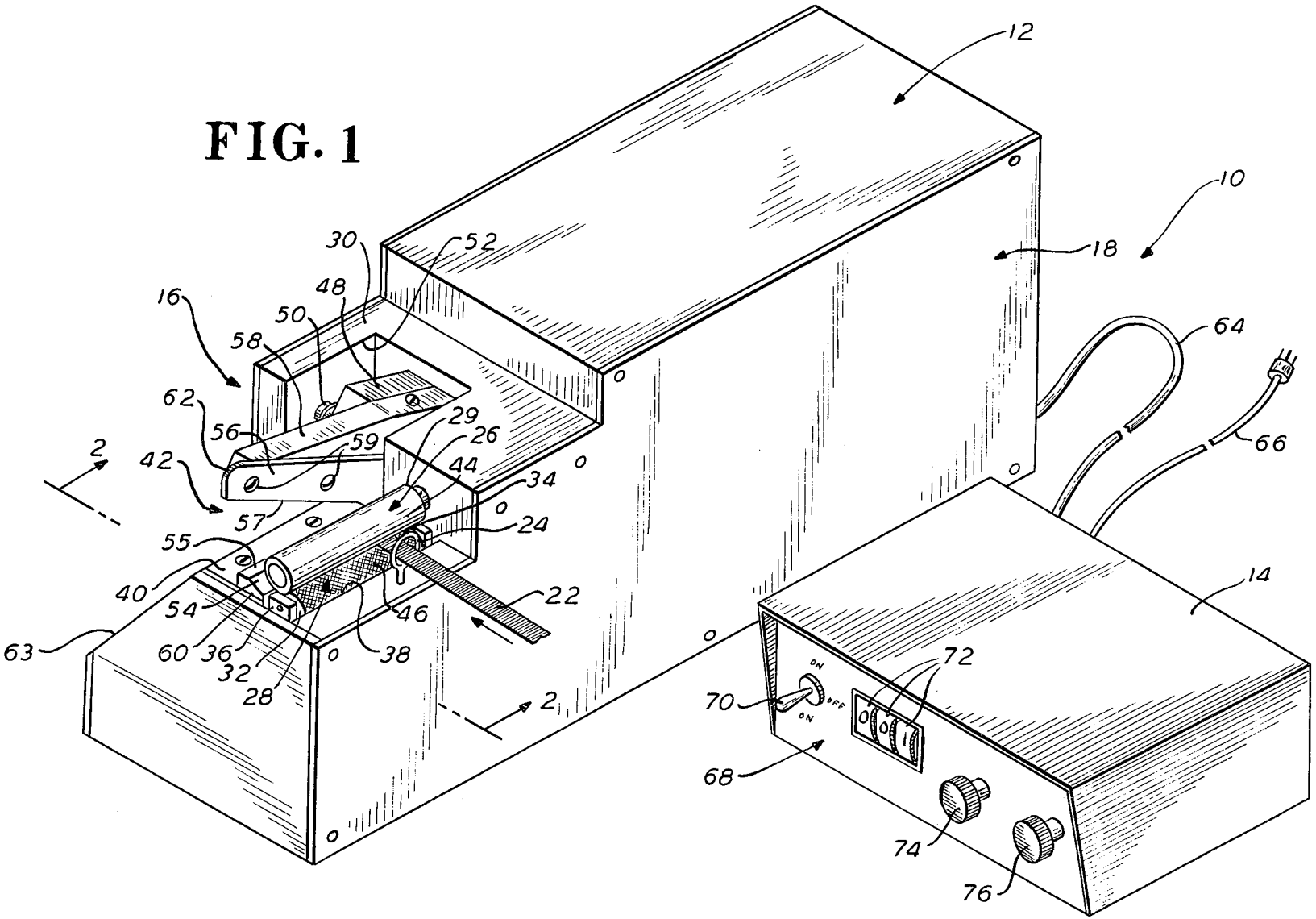
FIG. 1 is a pictorial representation of the preferred embodiment including the principles of the present invention.
Figure 4:
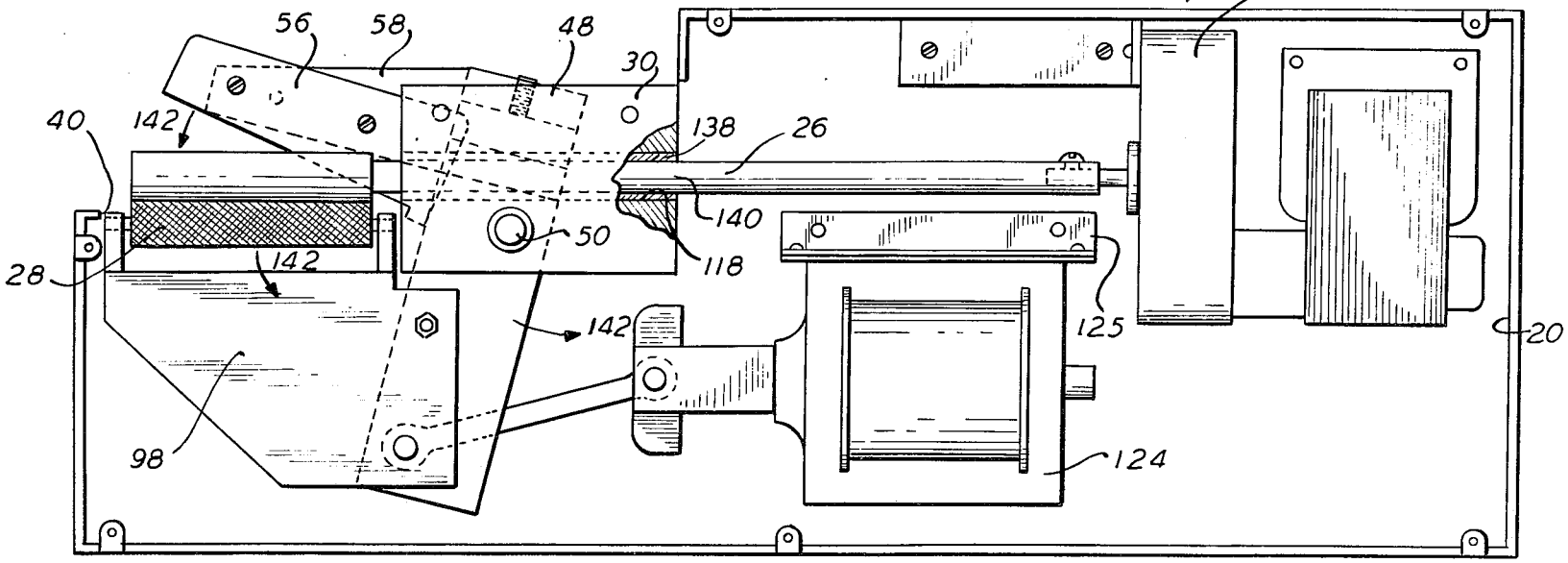
FIG. 4 is a side view in elevation of the preferred embodiment with the side panel thereof removed.

Referring now to the figures, and more particularly to FIG. 1, there is illustrated therein a strip cutting apparatus 10. The apparatus 10 includes a housing 12 and an electronic control unit 14. The housing 12 is elongated and provides an open work receiving portion 16 and an enclosed portion 18 forming a chamber 20 therein, as shown in FIG. 4. The chamber 20 is accessible by removal of the side panel 21.

A piece of strip material 22 is shown inserted through a guide 24 and sandwiched between a fixed position cantilever driven roller 26 and a moveable idler roller 28. The cantilever driven roller 26 is rotatably affixed on the end 29 thereof to a frame member 30 disposed within the work receiving portion 16 of the housing 12. The idler roller 28 is rotatably affixed on the free ends 32 and 34 thereof to a bracket 36. The bracket 36 and the idler roller 28 extend through an elongated opening 38 provided in a cutting table 40 of the work receiving portion 16.

The material is forced against the driven roller 26 by the idler roller 28 and, as the driven roller 26 rotates the strip material 22 is fed toward the cutting blade assembly 42. The driven roller 26 should provide a high coefficient of friction and is preferably covered with a sleeve 44 of a semi-resilient material such as rubber or the like. The idler roller 28 also should provide sufficient friction against the strip material 22 and preferably has a pattern of cross-hatched notches 46 engraved therein.

A pivot member 48 is shown pivotally affixed by a pivot rod 50 to the frame member 30 within a generally rectangular notch 52 provided therein. The cutting blade assembly 42 includes a first stationary blade 54 having a cutting edge 55 removeably secured to the cutting table 40 and a second moveable blade 56 having a cutting edge 57 removeably secured to the removeable arm portion 58 of the pivot member 48 by a plurality of screws 59. The blades 54 and 56 are disposed in an angular relationship in substantially the same vertical plane.

As the pivot member 48 is pivoted about the pivot rod 50 the blade 56 moves toward the blade 54 effecting a scissor-like cutting action wherein a moving point of tangency between the cutting edges 55 and 57 travels from the pivot rod 50 toward the free open ends 60 and 62, respectively, of the blades 54 and 56.

This scissor-like cutting action shears the material 22 and is very suitable for all types of materials including delicate fabrics and elastic. In contrast to a chop type cut where cutting edges remain in the same angular relationship during the cutting operation, no tearing or fraying of material is experienced. The portion 63 of the housing 14 adjacent the cutting table 40 is downwardly outwardly tapered to facilitate the removal of the strip material 22 after the cutting thereof by urging the material away from the cutting blade assembly 42.

The electronic control unit 14 controls the intervals at which the cutting blade assembly 42 is activated and the duration of each activation. The electronic control unit 14 is operably connected to the electrical components within the chamber 20 by a cable 64. A power cable 66 is shown and connects the control unit 14 to an appropriate power source. The front panel 68 of the electronic control unit 14 has operably disposed therein an on-off switch 70, a plurality of digital thumbwheel switches 72, and a pair of potentiometers 74 and 76 the functions of which are hereinafter described in conjunction with FIG. 9. Although the electronic control unit 14 is shown as a separate entity in relation to the housing 12 it may be incorporated therein.

Figure 2:
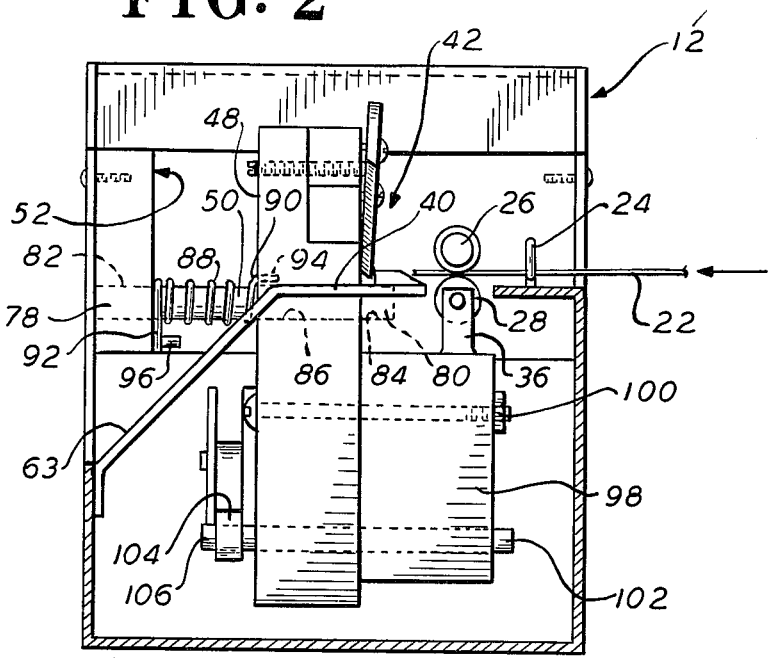
FIG. 2 is a front sectional view of the preferred embodiment taken substantially along the lines 2—2 of FIG. 1.

FIG. 2 illustrates the pivotal affixment of the pivot member 48 by the pivot rod 50 within the notch 52. The rod 50 journals on the free ends 78 and 80 thereof, respectively, within the aperture 82 and 84 located in the walls of the notch 52. The pivot rod 50 passes through and is fixidly secured by a set screw or the like in an elongated aperture 86 located in the pivot member 48 and is substantially parallel to the cutting table 40. The pivot rod 50 is coated with a suitable lubricant to reduce the friction generated thereby against the inner walls of the apertures 82 and 84. A coil type torsion spring 88 is disposed around the pivot rod 50 and is provided to urge the pivot member 48 and therefore the cutting blade assembly 42 into an open rest position as shown. The free end 90 of the spring 88 is inserted into a blind aperture 94 located in the pivot member 48 and the other free end 92 is engaged and retained by a stop 96 fixedly secured to the wall 82 of the notch 52 after the spring 88 is rotatably tensioned in the proper direction to urge the pivot member 48 in a position as described. Although the pivot member 48 is shown urged by the coil type torsion spring 88, other suitable tensioning means may be employed.

A support member 98 is fixedly secured by a bolt and nut assembly 100 and a rod 102 to the pivot member 48 and the pivot member 48 is preferably constructed of a unitary casting. The bracket 36 for the idler roller 28 is fixedly secured to the support member 98. When the cutting blade assembly 42 is closed by the pivoting of the pivot member 48, the support member 98 simultaneously withdraws the idler roller 28 from the driven roller 26 and the strip material 22 ceases contact therewith, pauses, and rests on the cutting table 40. A solenoid shaft coupling bar 104 is pivotally affixed to the rod 102 on the free end 106 thereof and journals therewith. The shaft coupling bar 104 may be retained on the rod 102 by a cotter pin or the like. The longitudinal axis of the povot rod 50 is substantially parallel to the longitudinal axis of the rod 102 and the longitudinal axis of the solenoid shaft coupling bar 104 is substantially normal thereto.

Figure 3:
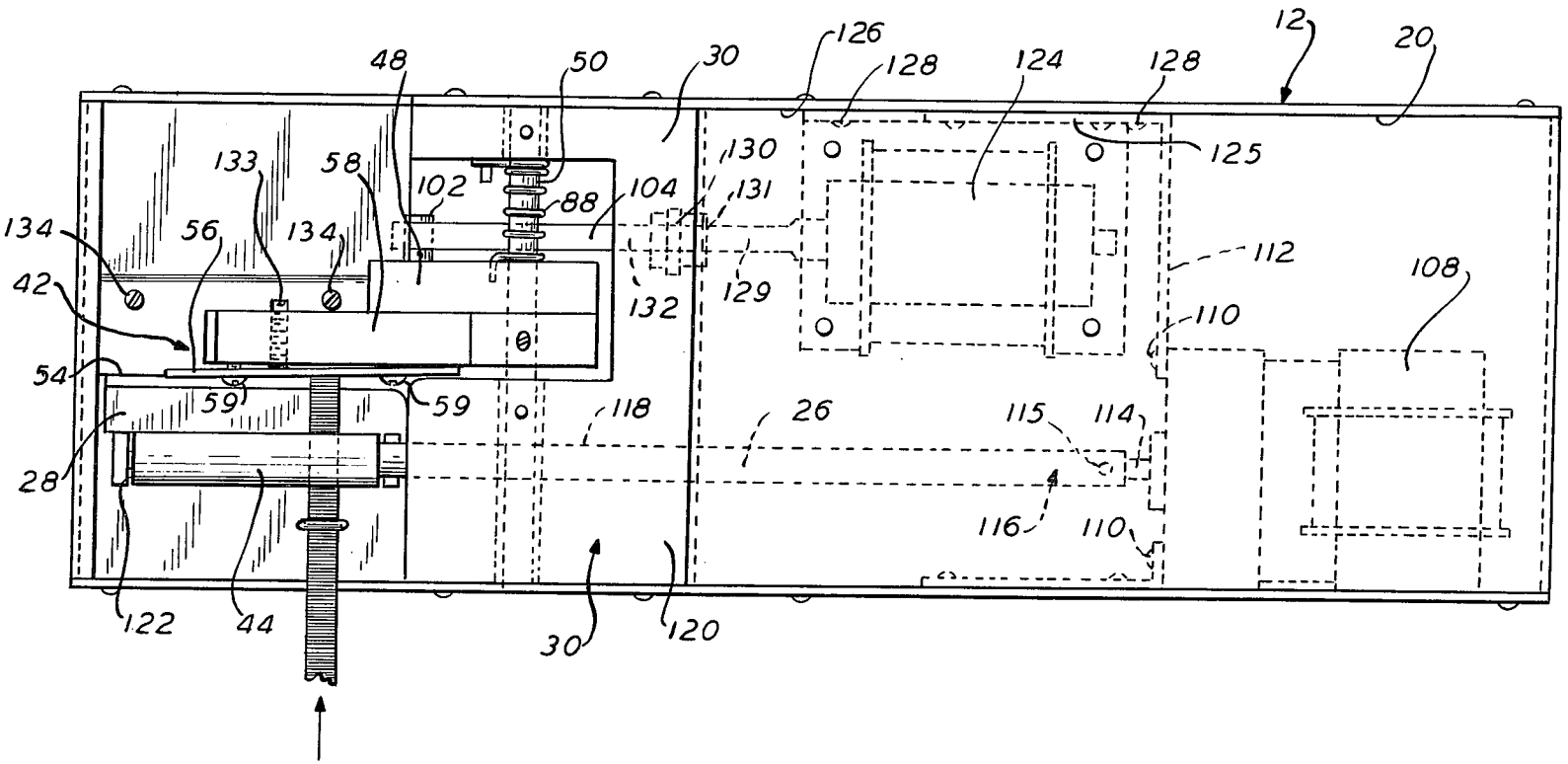
FIG. 3 is a top view of the preferred embodiment.

FIG. 3 is a top view of the housing 12 clearly illustrating the chamber 20 and the contents thereof. A constant speed motor 108 preferably adapted to be powered by 120 volts at sixty cycles is mounted by a plurality of bolts 110 to a panel 112 affixed to the housing 12 within the chamber 20. The driven shaft 114 of the motor 108 is coupled by a set screw 115 to the driven roller 26 on a free end 116 thereof. The driven roller 26 passes through an elongated drive aperture 118 in the portion 120 of the frame member 30 and journals therein. The driven roller 26 may be coated with a suitable lubricant to reduce friction with the inner walls of the elongated drive aperture or may be provided with a sleeve bearing or the like. The other end 122 of the driven roller 26 has the sleeve 44 fixidly secured therearound. If the driven shaft 114 is not coaxial to the driven roller 26 a suitable angular coupling may be employed.

An electrical solenoid 124 is fixedly secured by a horizontal plate 125 to the inner wall 126 of the enclosed portion 18 by a plurality of sheet metal screws 128 or the like. The moveable plunger 129 of the solenoid 124 is coupled on the free end 131 thereof by a pivotal coupling 130 to the free end 132 of the solenoid shaft coupling bar 104. The coupling bar 104 is urged toward the solenoid 124 when activated, thereby closing the cutting blade assembly 42 and simultaneously withdrawing the idler roller 28 from the driven roller 26. When the solenoid 124 is deactivated the torsion spring 88 returns the pivot member 48 to a rest position.

The angle of the second moveable blade 56 relative to the first stationary blade, in a generally vertical plane, is adjustable by the loosening of the plurality of screws 59 and the adjustment of a set screw 133 threadably disposed through the removeable arm portion 58 of the pivot member 48. A small adjustment is necessary as too small an angle between the blades 54 and 56 will cause a less than optimum cut, and too great an angle will cause excessive blade wear.

Figure 5:
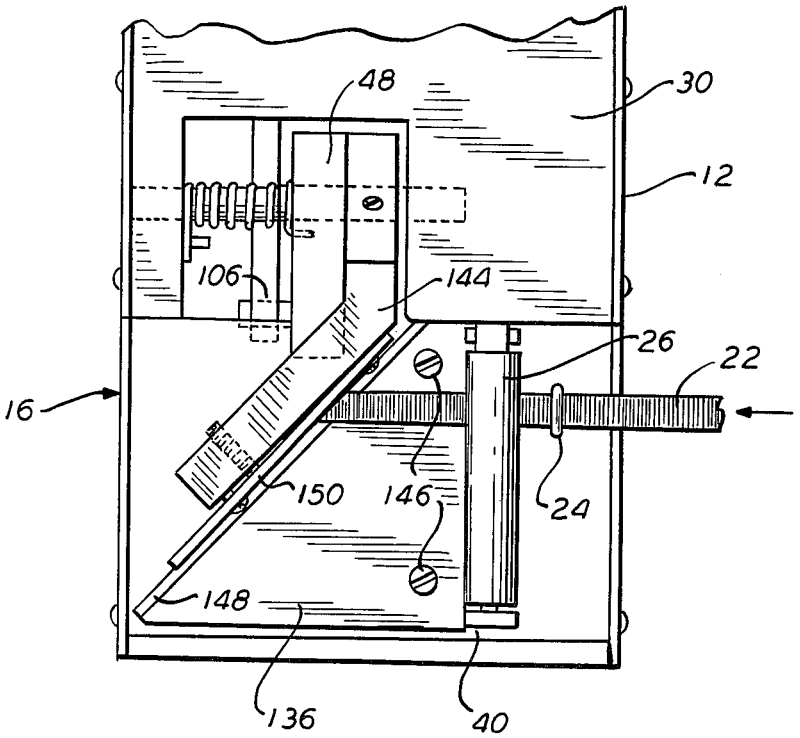
FIG. 5 is a partial top view of the open work receiving area including an alternate angle cutting arm.

A pair of threaded apertures 134 are provided in the cutting table 40 for the affixment of a supplementary cutting table 136 as shown in FIG. 5.

FIG. 4 illustrates the housing 12 with the side panel 21 thereof removed. The relative positioning of the constant speed motor 108 and the solenoid 124, and the represented designs thereof are arbitrary. A differently configured solenoid or motor within reasonable limits will perform equally well. The driven roller 26 is illustrated with a sleeve type bearing 138 on the portion 140 thereof passing through the elongated drive aperture 118. Dependent on the placement of the pivot rod 50 relative to the cutting table 40, a blade having a hyperbolic edge to replace the second blade 56 may be preferable to reduce the axial movement of the pivot member 48 required to effect a cut. The paths of movement of the pivot member 48, the support member 98 and therefore the second blade 56 and the idler roller 28 when the solenoid 124 is activated are illustrated by the arrows 142.

FIG. 5 illustrates the preferred embodiment 10 in use with an alternate angled arm portion 144 which has replaced the removeable arm portion 58. The supplementary cutting table 136 is affixed to the cutting table 40 by a pair of screws 146 adapted to threadably cooperate with the threaded apertures 134. A first angle cutting blade 148 is removeably secured to the supplementary cutting table 136 and a second angle cutting blade 150 is adjustably removeably secured to the alternate angled arm portion 144 in the same manner as the first and second blades 56 and 58 are respectively affixed to the cutting table 40 and the removeable arm portion 58. With the use of several different angled cutting arms and supplementary tables several different angled cuts can be effected.

Figure 7:
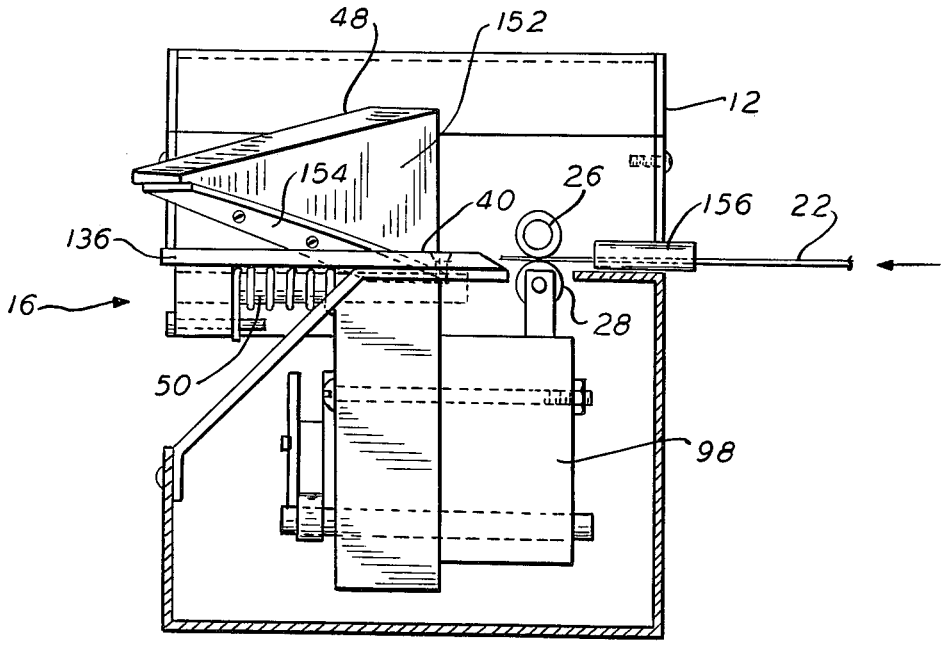
FIG. 7 is a front view of the open work receiving portion including the blade illustrated in FIG. 6.
Figure 6:
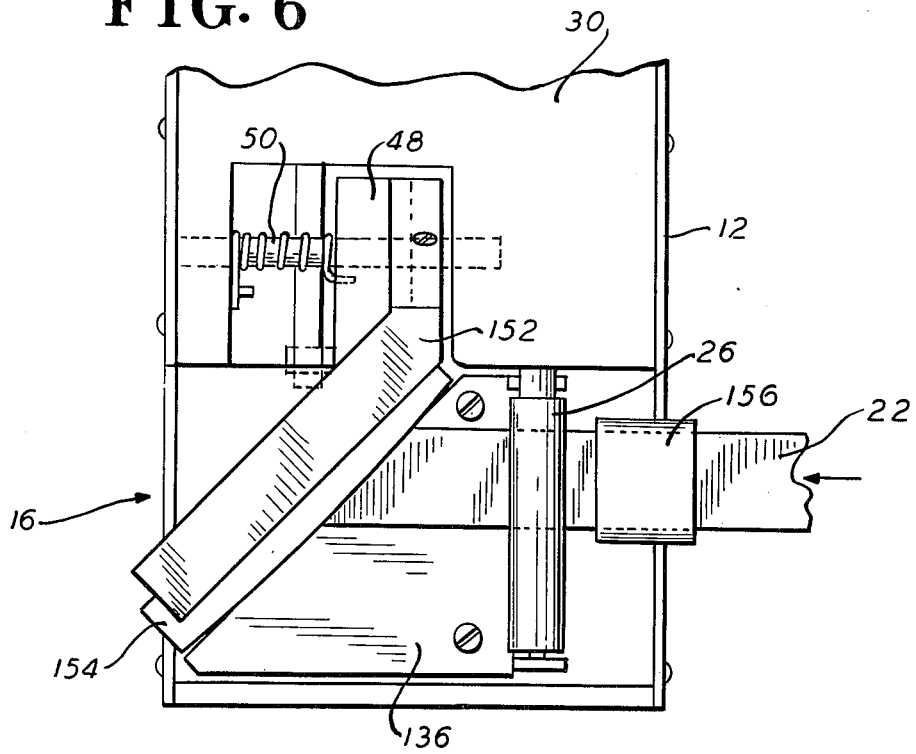
FIG. 6 is a partial top view of the open work receiving portion including an alternate embodiment of the angled cutting blade.

FIGS. 6 and 7 illustrate an alternate angled arm portion 152 in use with a moveable cutting blade 154 affixed thereto. In contrast to the second moveable blade 56 of FIGS. 1 and 2 and the second angle cutting blade 150 of FIG. 5 which have transverse axes substantially vertically disposed relative to the cutting table 40, the moveable cutting blade 154 has a transverse axis substantially parallel to the cutting table 40. This configuration is especially suited for use with a hyperbolic blade as described above or for pinking, contoured or other decorative cuts. An alternate guide 156 is shown affixed to the housing 12. The alternate guide 156 is a hollow open ended structure and is substantially rectangular in shape.

Figure 8:
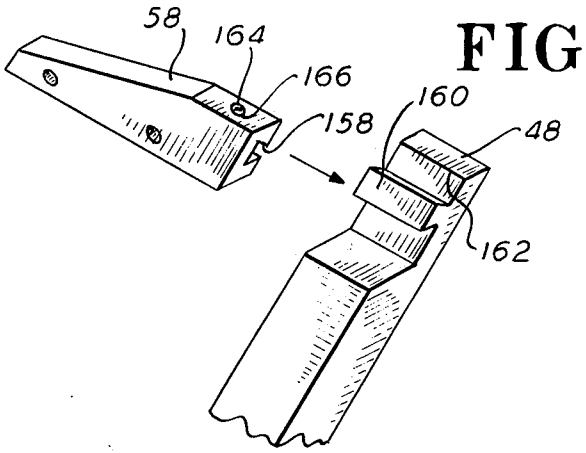
FIG. 8 is a partial pictorial representation of interchangeable blade detail of the preferred embodiment.

FIG. 8 illustrates the manner in which the removeable arm portion 58 is removeably affixed to the pivot member 48 and is indicative of the removeable affixment of the alternate angled arm portions 144 and 152. A substantially isosceles trapezoidal groove 158 is provided in the arm portion 58 and is dimensioned to capture and retain a complementary protrusion 160 provided on a notched portion 162 of the pivot member 48. A set screw 164 is threadably disposed in an aperture 166 located in the arm portion 58 and frictionally engages and may be tightened against the protrusion 160 when the arm portion 58 is positioned thereon.

Figure 9:
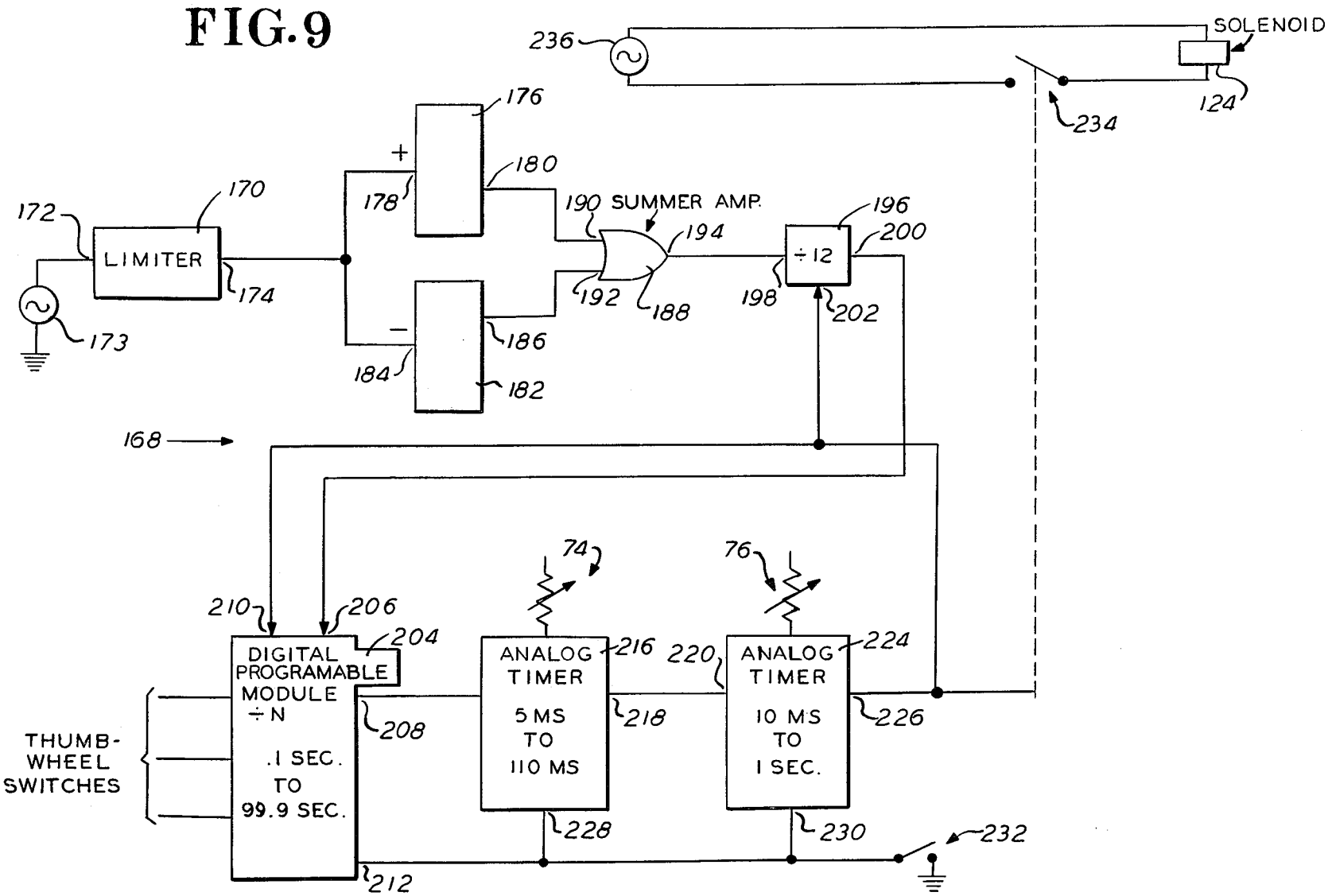
FIG. 9 is a functional block diagram of the electronic control means of the preferred embodiment.

FIG. 9 is a functional block diagram of the electronic control circuit 168 disposed within the electronic conrol unit 14 of FIG. 1. The electronic control circuit 168 includes a limiter circuit 170 having an input terminal 172 coupled to a source of alternating voltage 173 of preferably 117 volts at 60 hertz, and an output terminal 174. The limiter circuit limits the source of alternating voltage to a prescribed value.

A first one shot multivibrator 176 having an input terminal 178 and an output terminal 180, and a second one shot multivibrator 182 having an input terminal 184 and an output terminal 186, are connected in parallel on their input terminals 178 and 184 to the output the output terminal 174 of the limiter circuit. The multivibrators 176 and 182 provide unidirectional output pulses in response to the alternating voltage coupled from the limiter circuit 170.

A summing amplifier or OR gate 188 has a first input 190 coupled to the output terminal 180 of the one shot multivibrator 176 and a second input terminal 192 coupled to the output terminal 186 of the one shot multivibrator 182. The summing amplifier 188 provides a unipolar voltage at double the alternating voltage frequency at the output terminal 194 thereof.

A conventional dividing circuit 196 has the input terminal 198 thereof coupled to the summing amplifier output terminal 194 and also includes an output terminal 200 and a reset terminal 202.

A digital programmable timing module 204 having an input terminal 206, an output terminal 208, and automatic and manual reset terminals 210 and 212 is provided. The input terminal 206 is coupled to the output terminal 200 of the dividing circuit 196. The output terminal 208 of the digital programmable timing module 204 is connected in tandem to the input terminal 214 on a first analog timer 216 which in turn has an output terminal 218 connected to an input terminal 220 of a second analog timer 224. An output terminal 226 is provided on the second analog timer 224 and is coupled through a reset loop to the reset terminals 202 and 210 of the dividing circuit 196 and the timing module 204.

The manual reset terminal 212 of the timing module 204 is coupled to the manual reset terminals 228 and 230 respectively provided by the first and second analog timers 216 and 224. When the manual reset terminals are grounded through the microswitch 232 the timers 204, 216, and 224 are reset. The output terminal 226 of the second analog timer 224 is shown coupled to a mechanical switch 234 which applies an alternating voltage 236 to the solenoid 124 when a voltage pulse from the second timer 224 is produced at the output terminal 226 thereof. In practice, the output terminal 226 is preferably coupled through a programmed unijunction transistor (PUT) to a TRIAC which replaces the switch 234.

The digital programmable timer module 204 provides the digital thumbwheel switches 72 to vary the intervals between the voltage pulses and therefore the intervals between the activations of the solenoid 124 from 0.1 seconds to 99.9 seconds. If shorter times are desired the potentiometer 74 of the first analog timer 216 can be varied for times from five ms to one hundred and ten ms. The length of the activation of the solenoid 124 is determined by the setting of the potentiometer 76 provided by the second analog timer 224. If the activations of the solenoid 224 are extremely short and in rapid succession if desired, the deactivation of the solenoid 124 can mechanically trip the microswitch 232 to reset the timers 204, 216, and 224 thereby providing improved accuracy.

In operation the strip material 22 is placed through the guide 24 and through the rollers 26 and 28. Since the driven roller 26 is of the cantilever type, and the free and 122 thereof is adjacent to the open ends 60 and 62 of the blades 54 and 56 material wider than the drive roller 26 or parts connected by binding may be inserted and cut, notched, or the like. An advantage in the use of the cantilever drive shaft is that additional idler or drive rollers may easily be mounted adjacent to the circumference of the cantilever drive shaft to facilitate handling of elastics or materials drawn against tension. The time intervals desired between cutting strokes is selected and set on the thumbwheel switches 72 or the potentiometer 74. These controls may be calibrated in lengths of fabric cut if desired. The duration of the cutting stroke is then selected and set on the potentiometer 76. This control may be calibrated in graduations representing different hardnesses of fabrics.

When the corresponding timed pulse is delivered to the TRIAC or to the switch 234 the solenoid 124 is activated. This activation in turn withdraws the idler roller 28 from the driven roller 26 causing the strip material 22 to pause on the cutting table 40. Simultaneously, the cutting blade assembly 42 is closed and the strip material 22 is severed. When the voltage pulse ceases, the solenoid 124 is deactivated, the cutting blade assembly 42 is opened, and the idler roller 28 once again forces the strip material 22 against the driven roller 26, the rotation thereof causing the feeding of the strip material 22 to resume until another voltage pulse is provided by the electronic control circuit 168 to the solenoid 124.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A strip cutting apparatus comprising:

a. housing having a longitudinal and transverse axis and including an enclosed portion and an open work receiving portion;

b. means for feeding strip material along the transverse axis of said open portion, the driven portion of said feeding means engaging the upper surface of said strip material; and c. scissor-like means transversely disposed within said work receiving portion for shearing said strip material, said scissor-like means being activated simultaneously with the inactivation of said feeding means.

2. A strip cutting apparatus according to claim 1, wherein said feeding means includes a motor driven feed roller, and a substantially parallel juxtaposed idler roller for forcing said strip material against said feed roller, said strip material disposed between said idler and feed rollers and being driven thereby.

3. A strip cutting apparatus according to claim 2, wherein said motor comprises a constant speed electrical motor and said feeding means further includes guide means affixed to the work receiving portion of said housing for aligning said strip material with said rollers.

4. A strip cutting apparatus according to claim 1, wherein said scissor-like shearing means includes a pair of replaceable cutting blades, the first of said pair of blades being stationary and disposed beneath said strip material, the second of said pair of blades being disposed in an angular relationship in substantially the same vertical plane as said first blade, a pivot member including a pivot rod, said second blade being affixed to said pivot member on the distal end thereof, said pivot member being adapted to rotate towards said first blade causing a moving point of tangency between the cutting edges of said blades of travel from said pivot rod toward the free open ends thereof.

5. A strip cutting apparatus according to claim 4, further including means for selectively adjusting the angle of said second blade relative to said vertical plane, and the angle of said first and second blades are adjustable relative to the longitudinal axis of said pivot rod.

6. A strip cutting device according to claim 4, further including means for selectively adjusting the angle of said second blade relative to said vertical plane.

7. A strip cutting apparatus comprising:

a. a housing having a longitudinal and a transverse axis and including an enclosed portion and an upper work receiving portion;

b. means for feeding strip material along the transverse axis of said open portion, the driven portions of said feeding means engaging the upper surface of said strip material, said strip material caused to pause adjacent said shearing means by the withdrawal of said idler roller from adjacent said driving feed roller, said driven feed roller being of the cantilever type thereby permitting the insertion of said strip material between said driven feed roller and said idler roller from a position in front of the free end of said driven roller, said free end of said driven roller adjacent the free end of said second blade;

c. scissor-like means transversely disposed within said work receiving portion for shearing said strip material, said scissor-like means activated simultaneously with the inactivation of said feeding means; and d. electronic control means coupled to said scissor-like means for controlling the length and intervals of the activation thereof.

8. A strip cutting apparatus according to claim 7, wherein said feeding means includes a motor driven feed roller, and a substantially parallel juxtaposed idler roller for forcing said strip material against said feed roller, said strip material disposed between said idler and feed rollers and being driven thereby.

9. A strip cutting apparatus according to claim 8, wherein said motor comprises a constant speed electrical motor and said feeding means further includes guide means affixed to the work receiving portion of said housing for aligning said strip material with said rollers.

10. A strip cutting apparatus according to claim 8, further including solenoid means disposed within said enclosed housing portion for withdrawing said idler roller from said driven feed roller.

11. A strip cutting apparatus according to claim 7, wherein said scissor-like shearing means includes a pair of replaceable cutting blades, the first of said pair of blades being stationary and disposed beneath said strip material, the second of said pair of blades disposed in an angular relationship in substantially the same plane as said first blade, a pivot member including a pivot rod, said second blade being affixed on the distal end thereof, said pivot member being adapted to rotate towards said first blade causing a moving point of tangency between the cutting edges of said blades to travel from said pivot rod toward the free open ends thereof.

12. A strip cutting apparatus according to claim 7, wherein said electronic control means comprises:

a. limiter circuit means having input and output terminals, said input terminal being coupled to a source of alternating voltage for limiting said voltage to a prescribed valve;

b. positive and negative rectifier means each having input and output terminals, said rectifier input terminals being coupled in parallel to said limiter means output terminal for rectifying said alternating voltage;

c. summing amplifier means having first and second input and output terminals, said first summing amplifier input terminal being coupled to the output terminal of said positive rectifier means output terminal, said second summing amplifier input terminal being coupled to the output terminal of said negative rectifier means for providing a unipolar voltage at said summing amplifier output terminal at double the alternating voltage frequency;

d. dividing circuit means having input, output, and reset terminals, said dividing amplifier input terminal being coupled to said summing amplifier output terminal;

e. electronic timing means having input, output, and reset terminals, and including means for adjusting the timing intervals thereof, and providing a voltage pulse at the electronic timing means output terminal, said timing means output terminal being coupled to said timing means reset terminal, said timing means output terminal being coupled to said dividing circuit means reset terminal;

f. normally open switch means coupled to said timing means output terminal, said switch means being changed to a closed position when activated by said voltage pulse; and g. solenoid means coupled to said scissor-like means, said solenoid means serially coupled to said source of alternating voltage and said switch means, said solenoid having said alternating voltage connected thereto upon closing of said switch means.

13. A strip cutting apparatus comprising:

a. a housing having a longitudinal and a transverse axis and including an enclosed portion and an open portion;

b. means for feeding strip material along the transverse axis of said open portion, the driven portion of said feeding means engaging the upper surface of said strip material, said strip material caused to pause adjacent said shearing means by the withdrwal of said idler roller from adjacent said driven feed roller, said driven feed roller being of the cantilever type thereby permitting the insertion of said strip material between said driven feed roller and said idler roller from a position in front of the free end of said driven roller, said free end of said driven roller adjacent the free end of said second blade, said feeding means including a motor driven feed roller and a substantially parallel juxtaposed idler roller for forcing said strip material against said feed roller, said strip material disposed between said idler and feed rollers and being driven thereby, said motor comprising a constant speed electrical motor, said feeding means further including guide means affixed to the work receiving portion of said housing for aligning said strip material with said rollers, solenoid means disposed within said enclosed housing portion for withdrawing said idler roller from said driven feed roller;

c. scissor-like means transversely disposed within said work receiving portion for shearing said strip material, said scissor-like means activated simultaneously with the inactivation of said feeding means, said scissor-like shearing means including a pair of replaceable cutting blades, the first of said pair of blades being stationary and disposed beneath said strip material, the second of said pair of blades being disposed in an angular relationship in substantially the same vertical plane as said first blade, a pivot member including a pivot rod, said second blade being affixed to said pivot member on the distal end thereof, said pivot member being adapted to rotate towards said first blade causing a moving point of tangency between the cutting edges of said blades to travel from said pivot rod toward the free open ends thereof, means for selectively adjusting the angle of said second blade relative to said vertical plane, the angle of said first and second blades being adjustable relative to the longitudinal axis of said pivot rod; and d. electronic control means, said electronic control means controlling the intervals at which said solenoid is activated and the length of time of the activation, said electronic control means comprising limiter circuit means having input and output terminals, said input terminals being coupled to a source of alternating voltage for limiting said voltage to a prescribed valve, positive and negative rectifier means each having input and output terminals, said rectifier input terminals being coupled in parallel to said limiter means output terminal for rectifying said alternating voltage, summing amplifier means having first and second input and output terminals, said first summing amplifier input terminal being coupled to the output terminal of said positive rectifier means output terminal, said second summing amplifier input terminal being coupled to the output terminal of said negative rectifier means for providing a unipolar voltage at said summing amplifier output terminal at double the alternating voltage frequency, dividing circuit means having input, output, and reset terminals, said dividing amplifier input terminal being coupled to said summing amplifier output terminal, electronic timing means having input, output, and reset terminals, and including means for adjusting the timing intervals thereof, and providing a voltage pulse at the electronic timing means output terminal, said timing means output terminal being coupled to said timing means reset terminal, said timing means output terminal being coupled to said dividing circuit means reset terminal, normally open switch means coupled to said timing means output terminal, said switch means being changed to a closed position when activated by said voltage pulse, and solenoid means coupled to said scissor-like means, said solenoid means being serially coupled to said source of alternating voltage and said switch means, said solenoid having said alternating voltage connected thereto upon closing of said switch means.

14. A strip cutting apparatus comprising:

a. a housing having a longitudinal and a transverse axis including an enclosed portion and an open work receiving portion;

b. means for feeding strip material along the transverse axis of said open portion;

c. scissor-like means transversely disposed within said work receiving portion for shearing said strip material; and d. electronic control means coupled to said scissor-like means for controlling the length and intervals of the activation thereof, said electronic control means including:

1. limiter circuit means having input and output terminals, said input terminal being coupled to a source of alternating voltage for limiting said voltage to a prescribed value;
2. positive and negative rectifier means each having input and output terminals, said rectifier input terminals being coupled in parallel to said limiter means output terminal for rectifying said alternating voltage;
3. summing amplifier means having first and second input and output terminals, said first summing amplifier input terminal being coupled to the output terminal of said positive rectifier means output terminal, said second summing amplifier input terminal being coupled to the output terminal of said negative rectifier means for providing a unipolar voltage at said summing amplifier output terminal at a multiple of the alternating voltage frequency;
4. dividing circuit means having input, output, and reset terminals, said dividing amplifier input terminal being coupled to said summing amplifier output terminal;
5. electronic timing means having input, output, and reset terminals, and including means for adjusting the timing intervals thereof, and providing a voltage pulse at the electronic timing means output terminal, said timing means output terminal being coupled to said timing means reset terminal, said timing means output terminal being coupled to said dividing circuit means reset terminal;
6. normally open switch means coupled to said timing means output terminal, said switch means being changed to a closed position when activated by said voltage pulse; and
7. solenoid means coupled to said scissor-like means, said solenoid means being serially coupled to said source of alternating voltage and said switch means, said solenoid having said alternating voltage connected thereto upon closing of said switch means.

15. A strip cutting apparatus comprising:

a. a housing having a longitudinal and transverse axis and including an enclosed portion and an open work receiving portion;

b. means for feeding strip material along the transverse axis of said open portion, the driven portion of said feeding means engaging a surface of said strip material;

c. scissor-like means transversely disposed within said work receiving portion for shearing said strip material; and d. electronic control means coupled to said scissor-like means for controlling the length and intervals of the activation thereof, said electronic control means including:

1. circuit means responsive to a source of alternating voltage for providing a series of output pulses;
2. timing means including a visual indicating device and coupled to said circuit means for varying the timing intervals between said output pulse signals in accordance with the settings on said visual indicating device;
3. normally open switch means coupled to said circuit means and being activated to a closed position in response to one of said output pulses;
4. solenoid means coupled to said scissor-like means, said solenoid means being serially coupled between said source of alternating voltage and said switch means, said solenoid having said alternating voltage applied thereto upon closing of said switch means.

16. A strip cutting devide according to claim 1, further including means for selectively adjusting the angle of said second blade relative to said vertical plane.

17. A strip cutting apparatus comprising:

a. a housing having a longitudinal and a transverse axis and including an enclosed portion and an open portion;

b. means for feeding strip material along the transverse axis of said open portion, the driven portion of said feeding means engaging the upper surface of said strip material, said strip material caused to pause adjacent said shearing means by the withdrawal of said idler roller from adjacent said driven feed roller, said driven feed roller being of the cantilever type thereby permitting the insertion of said strip material between said driven feed roller and said idler roller from a position in front of the free end of said driven roller, said free end of said driven roller adjacent the free end of said second blade, said feeding means including motor driven feed roller and a substantially parallel juxtaposed idler roller for forcing said strip material against said feed roller, said strip material disposed between said idler and feed rollers and being driven thereby, said motor comprising a constant speed electrical motor, said feeding means further including guide means affixed to the work receiving portion of said housing for aligning said strip material with said rollers, solenoid means disposed within said enclosed housing portion for withdrawing said idler roller from said driven feed roller;

c. scissor-like means transversely disposed within said work receiving portion for shearing said strip material, said scissor-like means activated simultaneously with the inactivation of said feeding means, said scissor-like shearing means including a pair of replaceable cutting blades, the first of said pair of blades being stationary and disposed beneath said strip material, the second of said pair of blades being disposed in an angular relationship in substantially the same vertical plane as said first blade, a pivot member including a pivot rod, said second blade being affixed to said pivot member on the distal end thereof, said idler roller being mounted on said pivot member in a spaced relationship from said second blade, said pivot member being adapted to rotate towards said first blade causing a moving point of tangency between the cutting edges of said blades to travel from said pivot rod toward the free open ends thereof and the withdrawal of said idler roller from said strip material, means for selectively adjusting the angle of said second blade relative to said vertical plane, the angle of said first and second blades being adjustable relative to the longitudinal axis of said pivot rod; and d. electronic control means coupled to said scissor-like means for controlling the length and intervals of the activation thereof, said electronic control means including:

1. circuit means responsive to a source of alternating voltage for providing a series of output pulses;
2. timing means including visual indicating device and coupled to said circuit means for varying the timing intervals between said output pulse signals in accordance with the settings on said visual indicating device;
3. normally open switch means coupled to said circuit means and being activated to a closed position in response to one of said output pulses;
4. solenoid means coupled to said scissor-like means, said solenoid means being serially coupled between said source of alternating voltage and said switch means, said solenoid having said alternating voltage applied thereto upon closing of said switch means.

* * * * *